United States Patent [19]

Hopper

[11] Patent Number: 5,005,650

[45] Date of Patent: Apr. 9, 1991

[54] MULTI-PURPOSE WELL HEAD EQUIPMENT

[75] Inventor: Hans P. Hopper, Aberdeen, Scotland

[73] Assignee: The British Petroleum Company p.l.c., London, England

[21] Appl. No.: 483,484

[22] Filed: Feb. 22, 1990

[30] Foreign Application Priority Data

Feb. 23, 1989 [GB] United Kingdom ..... 8904123

[51] Int. Cl.[5] ..... E02D 5/74; E21B 23/04; E21B 33/038; E21B 43/01

[52] U.S. Cl. ..... 166/339; 166/339; 166/342; 166/349; 294/86.33; 405/195; 405/224

[58] Field of Search ..... 166/338–341, 166/342, 344, 345, 350, 351, 360, 365, 368, 349; 294/86.24, 86.25, 86.33, 86.3; 405/169, 188, 190, 195, 224, 211, 212; 285/24, 81, 84

[56] References Cited

U.S. PATENT DOCUMENTS

| | | | |
|---|---|---|---|
| 3,452,815 | 7/1969 | Watkins | 166/344 |
| 3,901,546 | 8/1975 | Piazza et al. | 294/86.15 |
| 4,387,771 | 6/1983 | Jones | 166/341 |
| 4,443,130 | 4/1984 | Hall | 405/190 |
| 4,460,047 | 7/1984 | Pokladnik | 166/341 |
| 4,591,296 | 5/1986 | Henderson et al. | 405/195 |
| 4,611,661 | 9/1986 | Hed et al. | 166/339 |
| 4,867,605 | 9/1989 | Myers et al. | 405/169 |
| 4,881,850 | 11/1989 | Abreo | 405/169 |

FOREIGN PATENT DOCUMENTS

| | | |
|---|---|---|
| 0139438 | 2/1985 | . |
| 2199871 | 7/1988 | United Kingdom . |
| 1256782 | 12/1971 | United Kingdom . |

*Primary Examiner*—Stephen J. Novosad
*Attorney, Agent, or Firm*—Larry W. Evans; Joseph G. Curatolo; Scott A. McCollister

[57] ABSTRACT

A guide base for a sub-sea well is formed in two parts, an annular portion fixed to a conductor housing and a retrievable portion surrounding and releasably attached to the annular portion. The retrievable portion can be recovered and used elsewhere if a well is suspended or abandoned or changed for another type of guide base after drilling and before completion. A trawler board deflector can also replace the retrievable guide base portion, and a retrievable protective cap may be placed on the well head housing of a suspended well. A hydraulically-operated multi-purpose tool may be used for placing or retrieving any of the retrievable items.

8 Claims, 16 Drawing Sheets

MULTI-PURPOSE WELL HEAD EQUIPMENT

This invention relates to multi purpose well head equipment, including a guide base for sub-sea drilling, part of which is retrievable, and to equipment for use in association with the base.

Drilling a sub-sea well using a surface vessel is initally done through a conductor housing and about 100 m. of conductor casing cemented into the sea bed. Surrounding the conductor housing is a drilling guide base with guide posts for placing a blow out preventer above it. The guide base and conductor housing are locked together on the drilling rig before running and landing. The guide base is suspended in the moon-pool of the rig and the conductor housing and its associated casing are run through the guide base until the conductor housing can be locked into the base. The assembly is then lowered into a 36 inch diameter drilled hole, and, possibly, landed on an already installed temporary guide base or mud mat. The conductor housing and associated casing are then cemented into the sea bed.

At the conclusion of the drilling operation the conductor housing and guide base are left in position. The guide base is, in fact, usually referred to as a permanent guide base (PGB) because it remains on the well head whatever the future of the well. If the well has to be suspended for some time, the guide base has to be left there. If the well is completed, the completion also has to use the existing guide base in place, the design configurations of the base preventing it from being retrieved from the well head itself.

Leaving permanent guide bases on suspended wells represents an expense, which would be avoidable if the conventional guide base were to be redesigned to make it retrievable. A retrievable guide base would also allow a different base to be used for completing a well.

The present invention proposes such a re-design of a drilling guide base and a set of alternative bases. It also provides a tool for retrieving the guide base. In addition it provides a protective cap for a well head, and a trawler board deflector for a well, which can be landed and retrieved using the guide base retrieval tool.

According to the present invention a guide base assembly for a sub-sea well comprises:

an annular portion adapted to fit around a conductor housing and be fixed to it, and a retrievable guide base portion having a central annulus, adapted to fit around and be releasably locked to the annular portion.

The annular portion may be attached to the conductor housing in the moon pool of a surface vessel but once attached remains fixed to it and stays in place with the conductor housing on the sea bed.

The annular portion may be designed to seat on a mud mat or temporary guide base and to that end, it may have curved plates depending from it which may act as a gimbal so that the annular portion is horizontal even on a sloping sea bed.

The annular portion may also have a number of attachment points (e.g. four) for guide lines, these guide lines then being available for landing and retrieval of the retrievable portion of the guide base or for other lowering or lifting operations.

The retrievable portion of the guide base may be releasably locked to the annular portion by a number of locking pins fitting into a groove in the annular portion. The locking and unlocking may be effected by keys depending from a vertically movable ring. Preferably, but not essentially, downward movement of the ring and keys locks the pins into the groove and upward movement releases them. The vertical locking and unlocking action allows the retrievable portion of the guide base to be locked and unlocked without the application of any torque.

The retrievable portion may have all the other normal features of a guide base, e.g. guide posts or a rectangular framework for the placement of blow out preventer stacks or other drilling or completion modules, cement funnels for the cementing of well casings and a bulls eye for guidance in placement. The bulls-eye may be viewed by a TV camera run down guide lines or deployed by a ROV.

The invention includes a protective cap for a well head housing for use if the drilling or completion of a well is suspended for any reason. The protective cap may be releasably locked to the well head housing using an identical mechanism to that used for releasably locking the retrievable guide base portion to the annular portion, i.e. locking pins actuated by a vertically movable ring and keys. The protective cap while sealing the well against ingress of water or sediments may have an entry point to allow flushing or other fluids to be injected into the well.

A trawler board deflector or other cover to protect a partially completed suspended well may also be used as part of the present invention, the cover having the same releasable locking mechanism as the retrievable guide base portion and being adapted to lock onto the annular portion if and when the retrievable guide base portion has been retrieved.

When a well is ready for completion, the retrievable guide base portion used for drilling may be replaced by a different design of guide base more suited to a completed well (e.g. a production guide base).

The invention includes a multi-purpose tool which may be deployed from drill pipe or other lowering string to effect any landing and locking or unlocking and retrieving operation which may be required on any of the retrievable pieces of equipment included within the present invention. Thus it may have a framework for surrounding, latching onto and effecting locking or unlocking of a protective cap as well as a framework for surrounding, latching onto and effecting locking or unlocking of a retreivable guide base portion or a trawler board deflector. Either framework of the tool may be used separately, or both may be used simultaneously, e.g. a protective cap may be landed and locked at the same time as a retrievable guide base portion is unlocked and retrieved, or vice versa.

The locking/unlocking mechanisms of the multi-purpose tool may be actuated mechanically, electrically, or, preferably hydraulically. With the preferred locking pins and vertically movable lock/unlock ring, the mechanism has only to be able to move the ring upwardly or downwardly, with no torque being required.

The invention is illustrated with reference to the accompanying drawings in which.

Figure 1A:
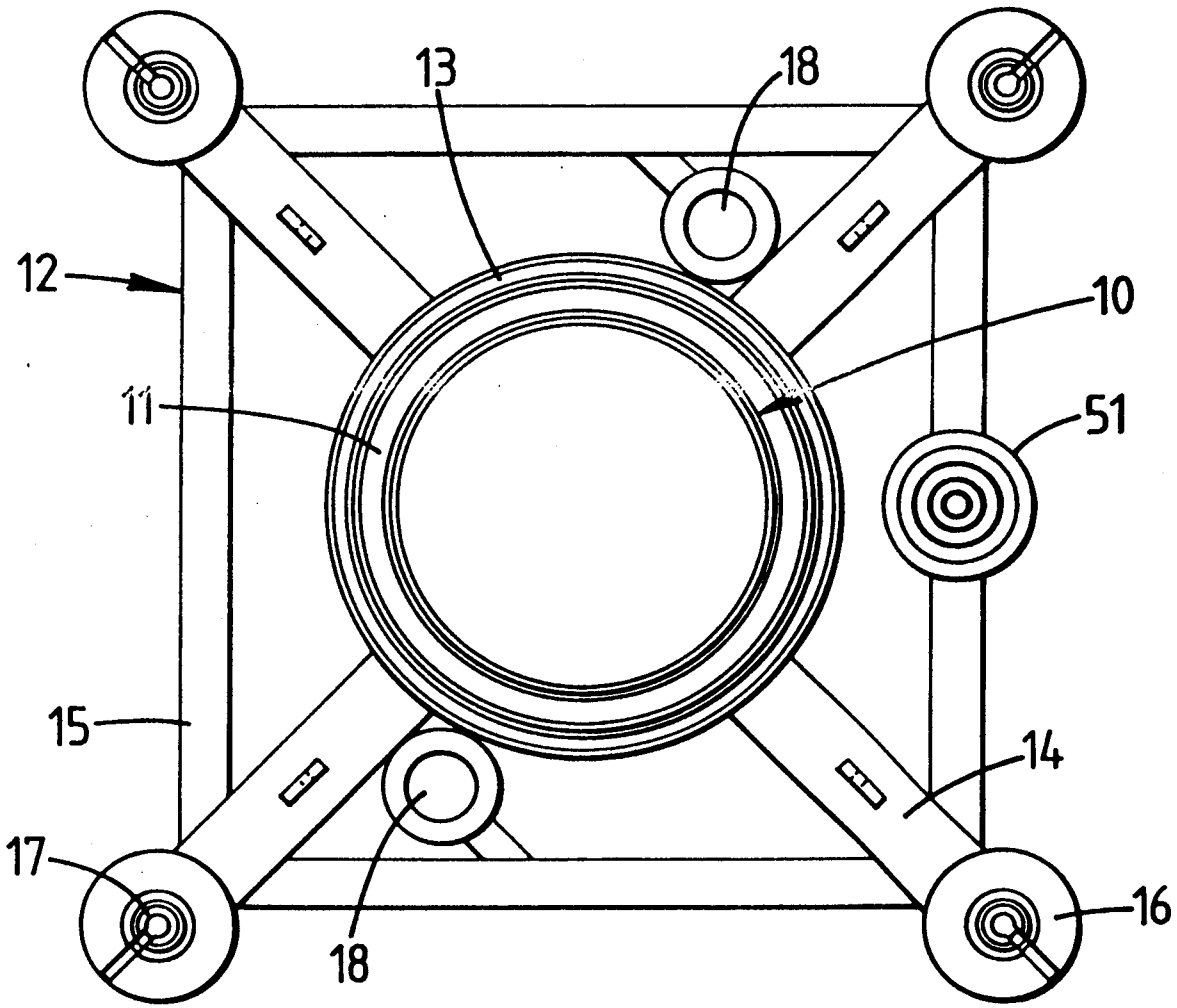
FIG. 1A is a plan view of a complete guide base according to the present invention

In FIG. 1A a 30 inch conductor housing 10 is surrounded by a retrievable guide base assembly. This is formed of an annular center portion 11 surrounding housing 10 and a retrievable guide base portion indicated generally at 12. This has itself a ring 13 around the annular portion supporting a rectangular framework of four diagonal arms 14 and outer frames 15. There are attachments 16 for holding guide posts 17 at the ends of the diagonals. Two funnels 18 are feeding funnels to top up the conductor hole annulus with cement, if necessary. A bulls eye 51 is attached to the top of one of the outer frames 15.

Figure 1B:
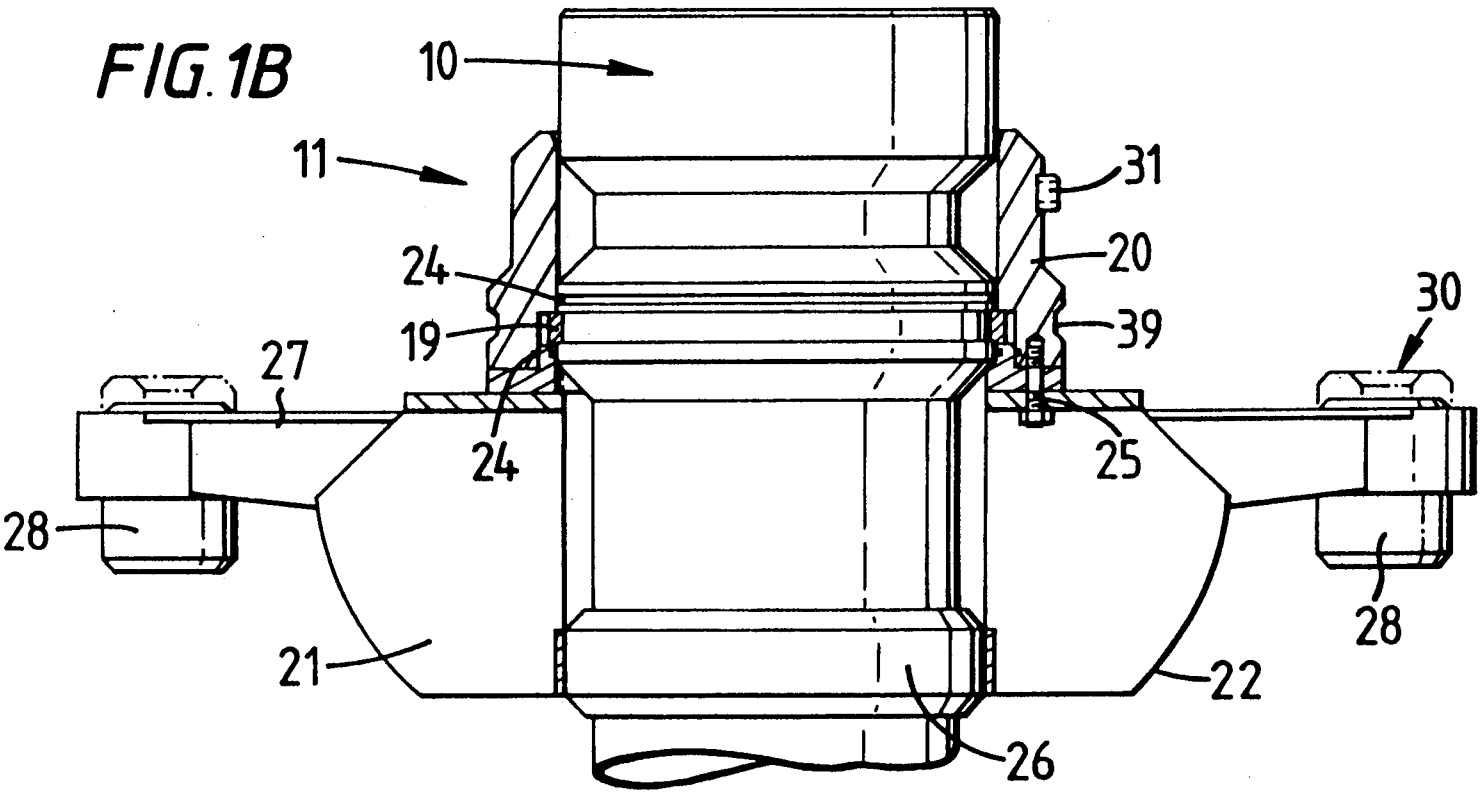
FIG. 1B is a section through the annular portion of the guide base of FIG. 1A with its associated conductor housing.

FIG. 1B shows more details of the annular portion 11 of the guide base of FIG. 1A. It is shown fitting around and fixed to conductor housing 10 by an inwardly biased spring ring 19 which fits into a groove of the conductor housing 10. Spring ring 19 is retained by an intermediate ring 20 and there are seals 24 above and below spring ring 19 to protect it from sea water and sediments.

Intermediate ring 20 is formed in two parts for ease of assembly of the annular portion. Screwed to the bottom of intermediate ring 20 by screws 25 are a number (e.g. 8) of plates 21, the edge of each plate being curved at 22. This enables the annular portion to be seated in a mud mat (23 of FIG. 1D) or temporary guide base, the curved plate corners acting as a gimbal and giving a degree of rocking movement so that the annular portion will sit horizontally even if the mud mat is on a sloping sea bed.

The bottoms of guide plates 21 are centralised on a circular projection 26 of conductor housing 10. Four arms 27 extend from guide plates 21 having at their ends cylindrical guides 28 for guide lines (29 of FIG. 1D). These guides may have internal profiles 30 allowing the guidelines either to pass through them or be latched to them, is of a form described in copending UK Patent Application No. 8914992 (Case 7099).

Figure 1C:
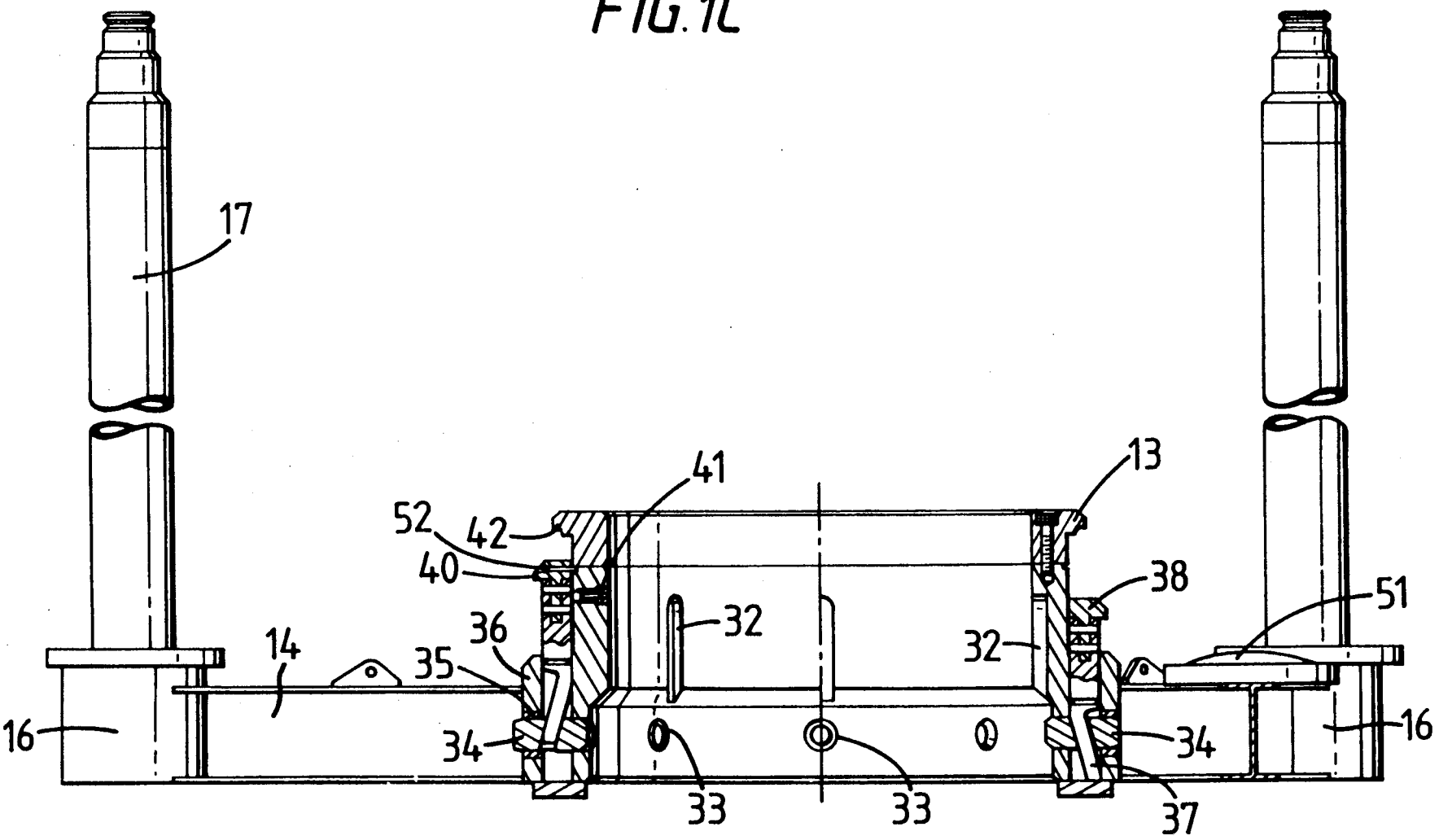
FIG. 1C is a section through the retrievable portion of the guide base of FIG. 1A.

An orientation key 31 is fixed to the outside of intermediate ring 20 to guide and align the retrievable portion of the guide base, a section through which is shown in FIG. 1C. Intermediate ring 20 also has groove 39 for receiving locking pins of the retrievable portion.

FIG. 1C shows the inner ring 13, diagonal arms 14, guidepost attachments 16, guide posts 17 and bulls eye 51 of FIG. 1A.

Inner ring 13 has a series of slots 32 and machine bores 33 in it, the former for cooperating with orientation key 31 of the annular portion to guide and align the retrievable portion on the annular portion and the latter for supporting a number of locking pins 34. There may be any convenient number of locking pins, eight being shown in FIG. 1C. Locking pins 34 are supported at both ends. The outer ends are supported in bushings 35 in a ring 36 integral with inner ring 13.

Locking pins 34 can be moved horizontally by angled keys 37 passing through angled holes in the pins, these angled keys 37 being fixed underneath a lock/unlock ring 38 having a shoulder 40 at its top. FIG. 1C shows a locking pin 34 in its unlocked position on the left hand side of the drawings and a locking pin 34 in its locked position on the right hand side of the drawing. It will be understood that this is for purposes of illustration only and that all the pins will act together, downward pressure on lock/unlock ring 38 forcing angled keys 37 through the holes in the pins and hence moving the locking pins inwardly into engagement with groove 39 of the annular portion of the guide base. An upward force applied to the underneath of shoulder 40 of lock-/unlock ring 38 will move the pins out again and free the retrievable portion of the guide base from the annular portion.

Lock/unlock ring 38 has a shear pin 52 which extends into inner ring 13 and holds lock/unlock ring 38 and keys 37 in their upper (left hand side of drawing) positions. A positive pressure at least equal to the shearing strength of shear pin 52 is required to move pins 34 into their locked positions. Inner ring 13 also has a shoulder 42 at its top.

Also mounted in inner ring 13 is a spring-loaded shear pin 41. With lock/unlock ring 38 in its upper (unlocked) position, ring 3B holds pin 41 in, but when ring 38 is pushed down to its locked position, pin 41 springs out and keeps ring 38 down.

Figure 1D:
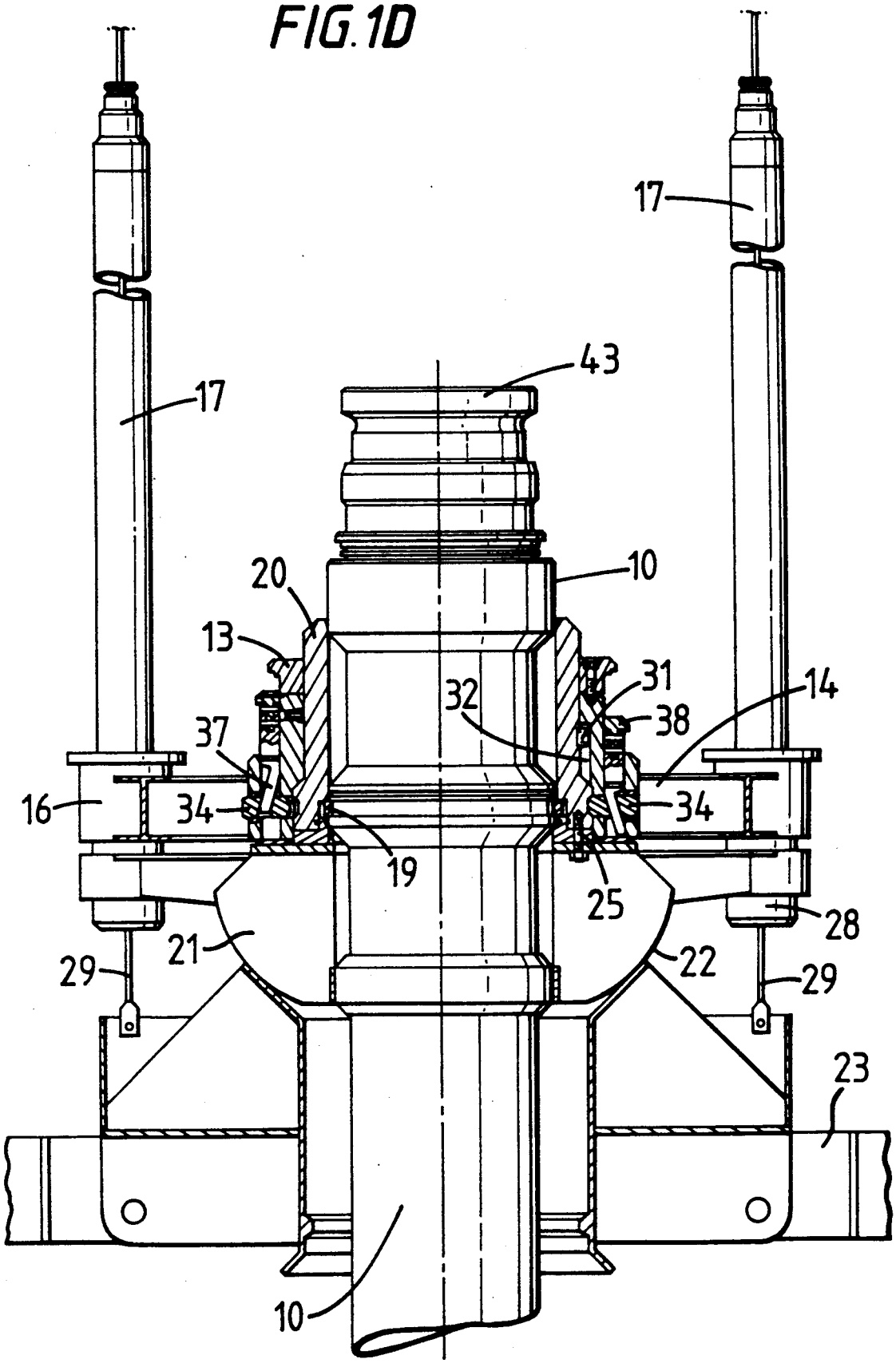
FIG. 1D is a section through the complete, assembled guide base of FIG. 1A.

FIG. 1D shows the annular and retrievable portions of the guide base in their assembled positions, with again the left hand side of the drawing showing a locking pin 34 in the unlocked position and the right hand side one in the locked position. It also shows how guide plates 21 with their rounded edges 22 seat the annular portion of the guide base onto a mud mat 23 while allowing a degree of tilt, if required, as between the mud mat and the annular portion.

Guide lines 29 are shown attached to the mud mat and extending up through cylindrical guides 28 of the annular portion and the attachments 16 and guide post 17 of the retrievable portion. The guide lines 29 are positioned at the time of lowering the mud mat and prior to the assembly and lowering of the guide base.

As explained in the preamble, initial drilling of a sub-sea well is carried out through conductor housing 10 and its associated casing. As drilling proceeds, further lengths of smaller diameter casing can be set within the conductor casing, including 20 inch casing suspended from an 18¾ inch well head housing. The well head housing and casing are run and landed together within the conductor housing and casing. They are shown in FIG. 1D (and subsequent Figures) at 43 and, as will be explained hereafter, may be utilised in other aspects of the present invention.

To assemble the guide base assembly in the moon pool of a drilling vessel, annular portion 11 is attached to conductor housing 10 by the spring ring 19 as previously described. The retrievable guide base portion of FIG. 1C is attached to annular portion 11 prior to attaching annular portion 11 to conductor housing 10. It could be done for example, on the deck of the vessel. The retrievable guide base portion is placed around annular portion 11, with the diagonal framework 14 of the retrievable guide base portion in line with the diagonal arms 27 of the annular portion and with orientation key 31 aligned with one of the slots 32 of the retrievable portion.

Orientation key 31 ensures that the retrievable portion remains correctly orientated with respect to the annular portion, particularly that the guide posts 17 of the retrievable portion are above the cylindrical guides 28 of the annular portion.

Shear pin 52 holds lock/unlock ring 38 up for this orientation and hence ensures that locking pins 34 are unlocked and do not hinder the assembling. Once orientated, however, downward pressure on lock/unlock ring 38 will lock pins 34 into groove 39 of the annular portion thus locking the retrievable and annular portions of the guide base together. The downward pressure will shear pin 52 and shear pin 41 will spring out to hold ring 38 down.

The assembly can now be transferred to the moon pool of the surface vessel. Guide lines 29 are threaded or slotted through guides 28 and guide posts 17 and the annular portion 11 is attached to conductor housing 10. The whole guide base assembly and the conductor housing can now be lowered to the sea bed down guide lines 29 onto the previously placed mud mat as shown in FIG. 1D.

For an initial assembly on a surface vessel, shear pin 52 only holds lock/unlock ring 38 in the unlocked position for assembly. However the essence of the present invention is that the retrievable portion can be lowered and placed separately from the annular portion and conductor housing. This separate lowering could be done initially if required and will certainly be done if a well is suspended. For separate lowering, shear pin 52 ensures that locking pins 34 remain unlocked against any accidental contact and are not locked until the retrievable portion has been safely landed onto an annular portion on the sea bed.

For recovery of a retrievable portion, the reverse sequence of operations will be used. Lock/unlock ring 38 can be pulled up releasing the lock pins 34 of the retrievable portion from groove 39 of the annular portion. Shear pin 52 will have been sheared during the locking so will not have any effect, but the upward pull in ring 38 should be sufficient to shear spring loaded shear pin 41, which would otherwise hold ring 38 down.

As shown in FIG. 1D, a sub-sea well will normally have a well head housing 43 and casing in addition to a conductor housing and casing. If the well is to be suspended for a period, the present invention allows the guide base to be recovered and re-used. However, during the period of suspension, it is desirable to protect the well by covering it with a protective cap. Such a cap is shown at the top of FIG. 2 in position on the top of well head housing 3.

Figure 2:
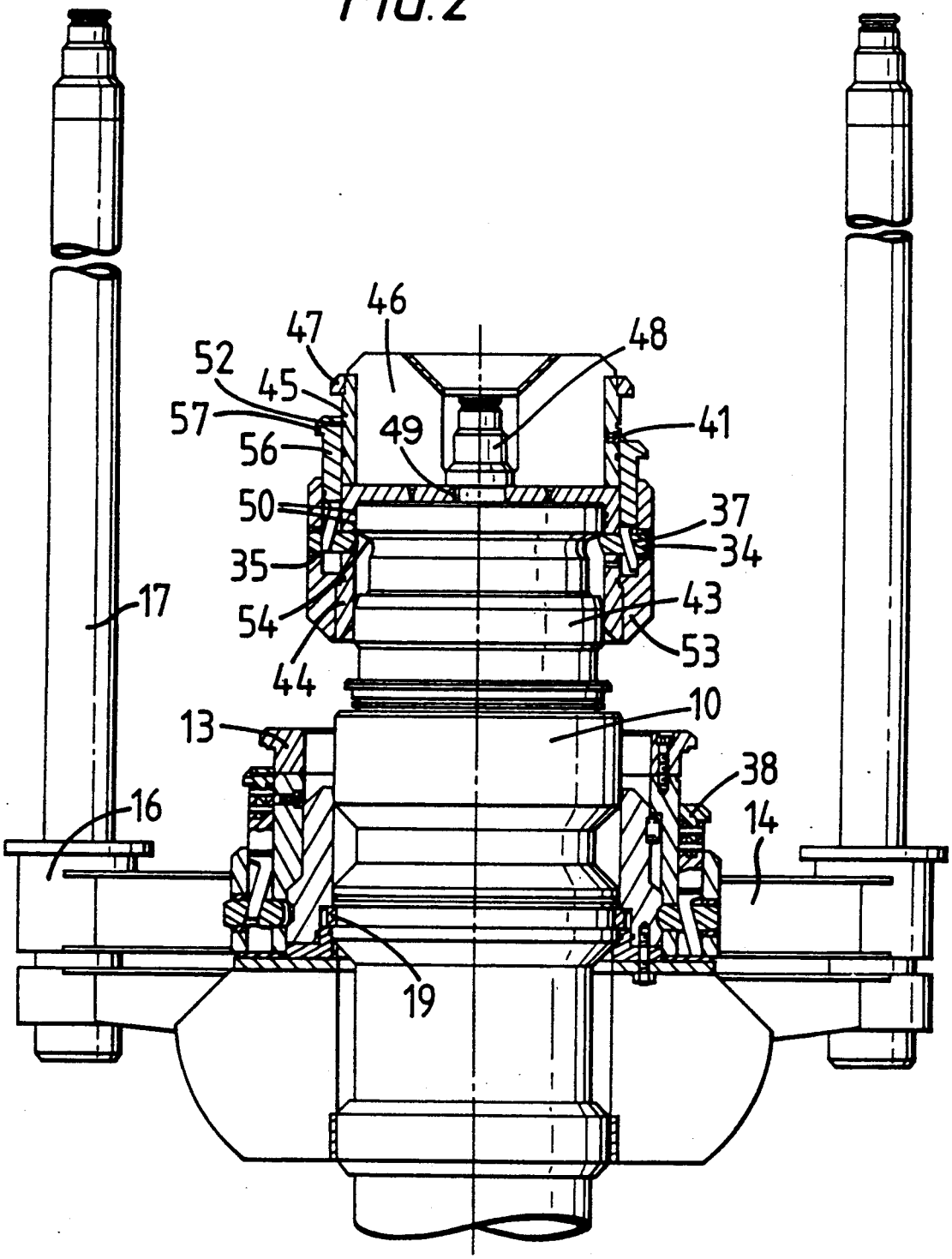
FIG. 2 is a section through a protective cap for a well head housing.

In FIG. 2, the guide base assembly is shown still in position. The protective cap is formed of an inverted circular cup 44 which fits closely over well head 43. Above cup 44 and fixed to it is an upward cylindrical extension 45 with radial plates 46. Extension 45 has a lip 47 by which the cap may be held for lowering or retrieval and the radial plates 46 surround a central entry pin 48 above a central hole 49 in cup 44. This allows the cap to be penetrated by a suitable stab (e.g. stinger 99 of FIG. 7) so that the well may be flushed or injected as required with fluid. Seals 50 seal cup 44 at the top of the well head.

FIG. 2 illustrates that the mechanism for locking the protective cap onto a well head is identical with the mechanism for locking a retrievable portion of a guide base to an annular portion.

Thus the cap has locking pins 34 passing through holes in cup 44 and supported at their outer ends by bushings 35 in an outer circular sleeve 53 of the cap. Locking pins 37 line up with groove 54 of the well head and can be locked into, or unlocked from, the groove by the same angled keys 37 passing through angled holes of the locking pins. Keys 37 are attached to lock/unlock ring 56 with its shoulders 57.

Lock/unlock ring 56 has shear pin 52 in it extending into extension 45 to hold ring 56 in its up position against accidental contact and extension 45 has spring load shear pin 41 to hold ring 56 down when the cap is locked.

The protective well head cap of FIG. 2 can thus be lowered and locked, or unlocked and retrieved in exactly the same way as a retrievable guide base portion. As will be described hereafter, a multi-purpose tool capable of landing or retrieving either a retrievable guide base portion or a protective cap may be used.

As previously indicated the facility of being able to release the retrievable portion of the guide base portion on the sea bed allows it to be recovered and used elsewhere if the well is suspended. If the well is to be completed, it could be left in place as the base for supporting a well head, but it may be convenient to use a different base for a completed well. An important feature of this design is its ability to remove the guide base portion over an in-place protective cap.

Figure 3:
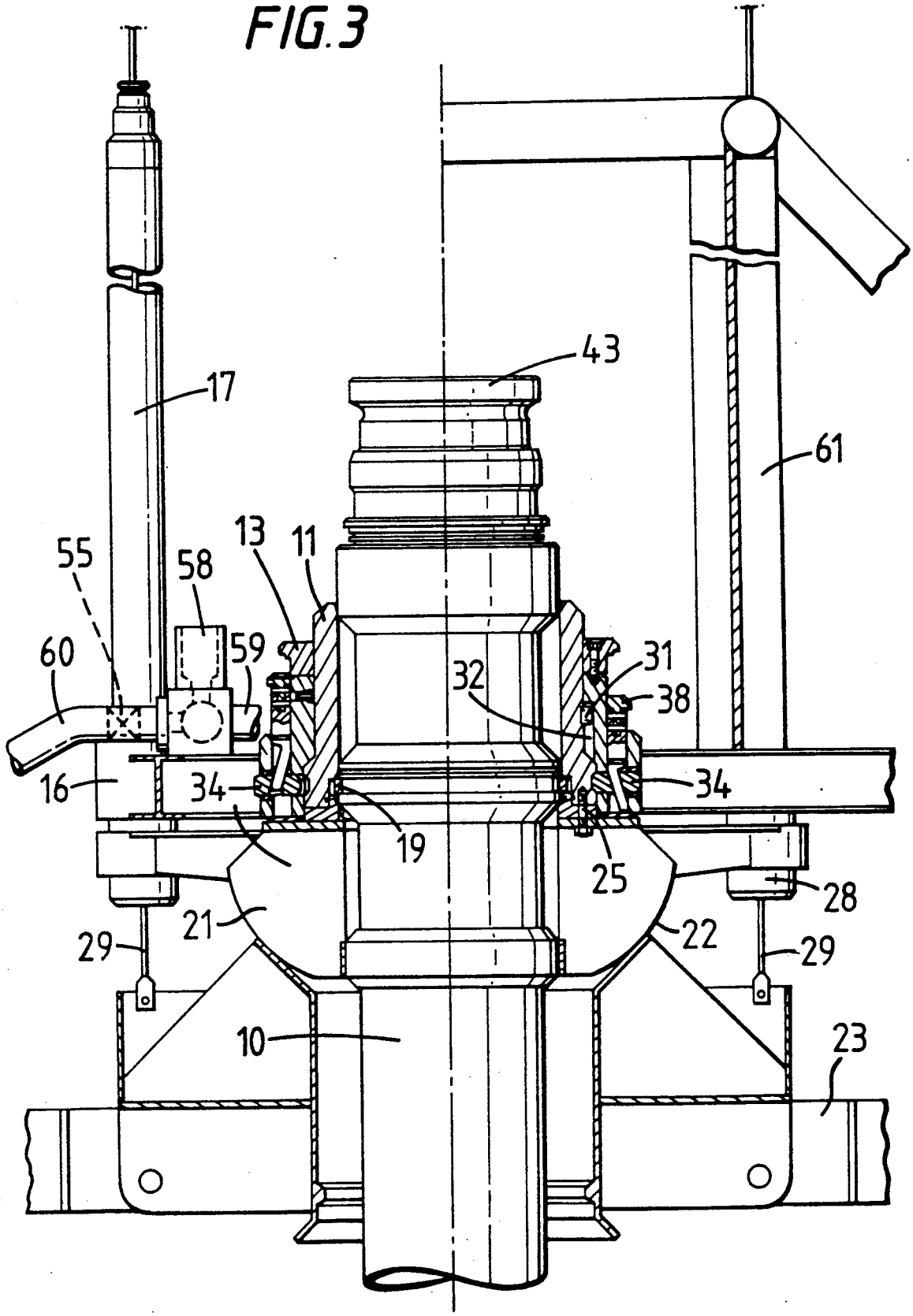
FIG. 3 shows two alternative retrievable guide base portions to that of FIGS. 1A, 1C and 1D.

FIG. 3 is a composite figure showing two different forms of base which could replace the retrievable drilling guide base portion. In the center of FIG. 3 is the conductor housing 10, with well head housing 43 protruding from it. Housing 10 has annular portion 11 fixed to it. On the left hand side of FIG. 3 is a base suitable for completing an individual satellite well. The base has ring 13 with a releasable locking mechanism as for the drilling guide base and diagonal arms 14 with guide post attachments 16 and guide posts 17. A typical production arrangement for such a production tree may have a stab receptacle 58 for a flow line stab, a flow spool 59 and flow line 60 so that oil or gas from the tree can be fed away from the well to a distant gathering point. The flow spool 59 may have a flow line spool valve (not shown) and flow line isolation valve 55 to control the oil or gas flow.

The right hand side of FIG. 3 shows a base with ring 13 and a releasable locking mechanism but this time with an orientation and guide frame 61 for positioning a tree assembly. Such a base could be used, for example, for a sub-sea oil production system as described and claimed in UK Patent Application No. 2174442A or in UK Patent Application No. 2202561A.

Figure 4:
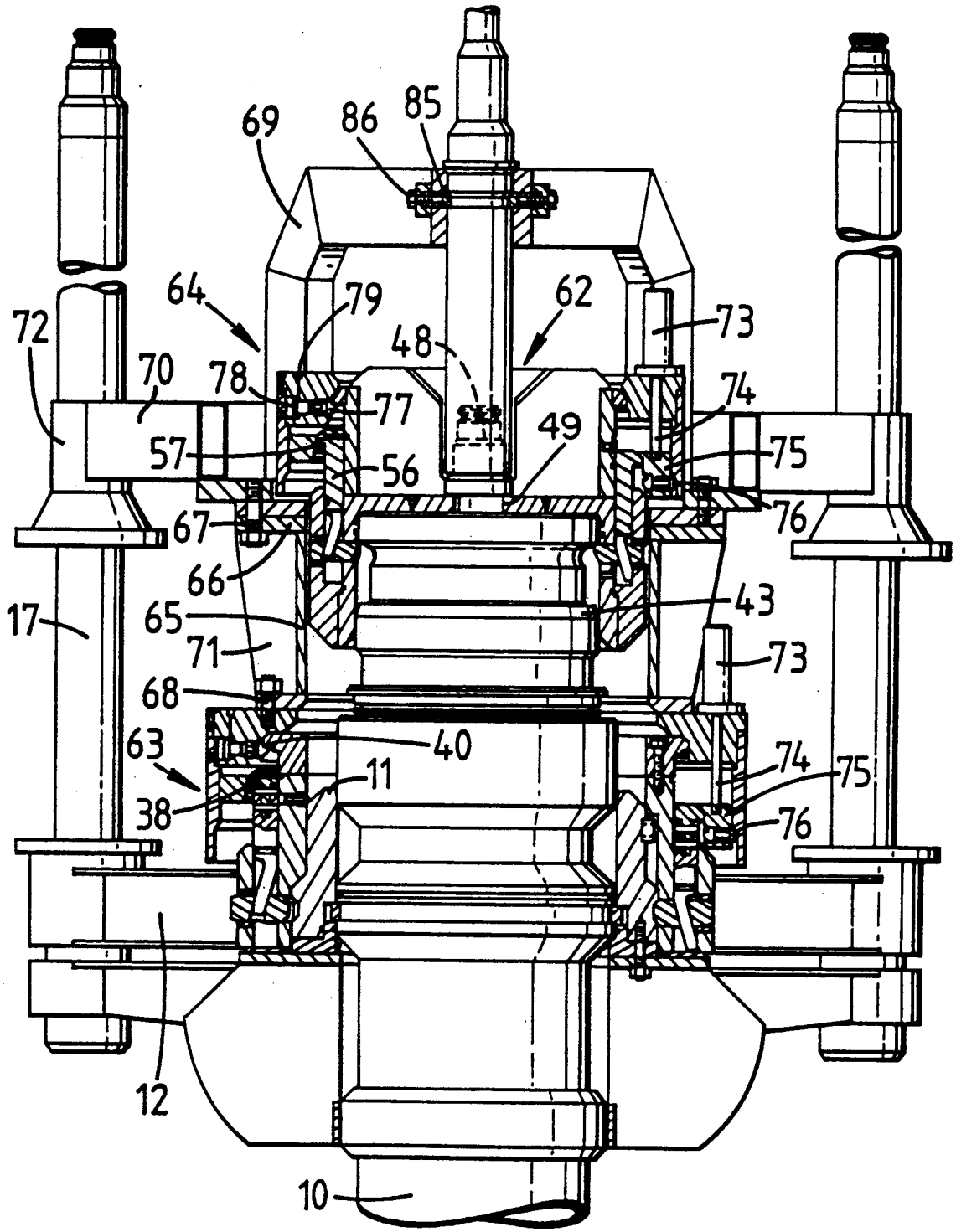
FIG. 4 shows a multipurpose tool for landing or retrieving a retrievable guide base portion and/or a protective well head housing cap.

The initial landing of a retrievable guide base at the same time as the conductor housing is run and landed has been previously scribed. The retrieval of a guide base portion from the sea bed and its replacement requires only a vertical movement of lock/unlock ring 38 to lock or unlock the base from the annular portion 11 and conductor housing 10. This vertical movement could be effected by a diver or a suitably adapted ROV and the base retrieved and replaced by conventional lifting and running means. However, the present invention includes a multi-purpose tool for such retrieval and replacement and it is shown in FIG. 4. This multi-purpose tool may be controlled from a surface vessel, without the need for divers or an ROV. It could thus be used in any depth of water.

FIG. 4 shows a sub-sea well with its conductor housing 10, well head housing 43, annular portion 11 and retrievable guide base portion 12. The well also has a protective cap (as shown in FIG. 2) indicated generally at 62.

The multi-purpose tool of FIG. 4 has four main parts. There is a framework indicated generally at 63 capable of fitting over and around the lock/unlock mechanism of the guide base and another framework indicated generally at 64 capable of fitting over and around the protective cap 62 of the well head housing.

The top of framework 63 has an upward cylindrical extension 65 with flange 66 so that framework 63 and 64 can be bolted together by bolts 67. Extension 65 has bolts 68 bolting it to framework 63 and strengthening webs 71.

Surrounding and above protective cap framework 64 and separate from it is the carrier for frameworks 63 and 64. This consists essentially of a spider-like frame 69 which can be attached to drill pipe or other running string. From this spider-like frame 69, four side arms 70 extend outwardly supporting at their ends guide tubes 72 capable of fitting over guide posts 17 of the retrievable guide base portion.

From the top of spider-like frame 69 a tubular mandrel may extend down to the injection pin 48 of protective cap 62. Frame 69 may be attached to this tube and hence the running string by spring dogs 85 fitting in a groove of the tube, the dogs 85 being held in place by spring-loaded bolts 86. This positive but simple arrangement allows frame 69 to be readily attached to a running string in the moon pool of a surface vessel.

It will be seen that the multi-purpose tool of FIG. 4 with its modular construction of frames 63, 64, 69 and extension 65 can be easily assembled and used with either one or both of frames 63 and 64 in place. If only action on a protective cap is required framework 63 and extension 65 can be omitted. If only action on a retrievable guide base portion is required framework 64 can be omitted. However both frameworks 63 and 64 can be deployed and used in the same running operation, e.g. to run and land a protective cap while unlocking and retrieving a retrievable guide base portion.

The mechanisms in frameworks 63 and 64 for locking or unlocking the relevant parts and for latching on to them are the same, and are actuated hydraulically.

On the top of frameworks 63 and 64 are a number (e.g. 4 on each framework) of hydraulic cylinders 73 with a double action piston inside. From the pistons, rods 74 extend down and are fixed into a ring 75 capable of bearing on the lock/unlock ring 56 of the protective cap or lock/unlock ring 38 of the retrievable guide base portion. Ring 75 has a number of spring loaded pins 76 at its base capable of engaging with the underneath of shoulder 40 (FIG. 1C) or shoulder 57 of the lock/unlock rings of the retrievable guide base portion or the protective cap.

Frameworks 63 and 64 also have means for latching onto retrievable guide base portion or protective cap under shoulders 42 or 47. The means are a number of spring loaded segments 77 which have also hydraulic pistons 78 to which hydraulic fluid can be applied via ports 79.

Figure 5A:
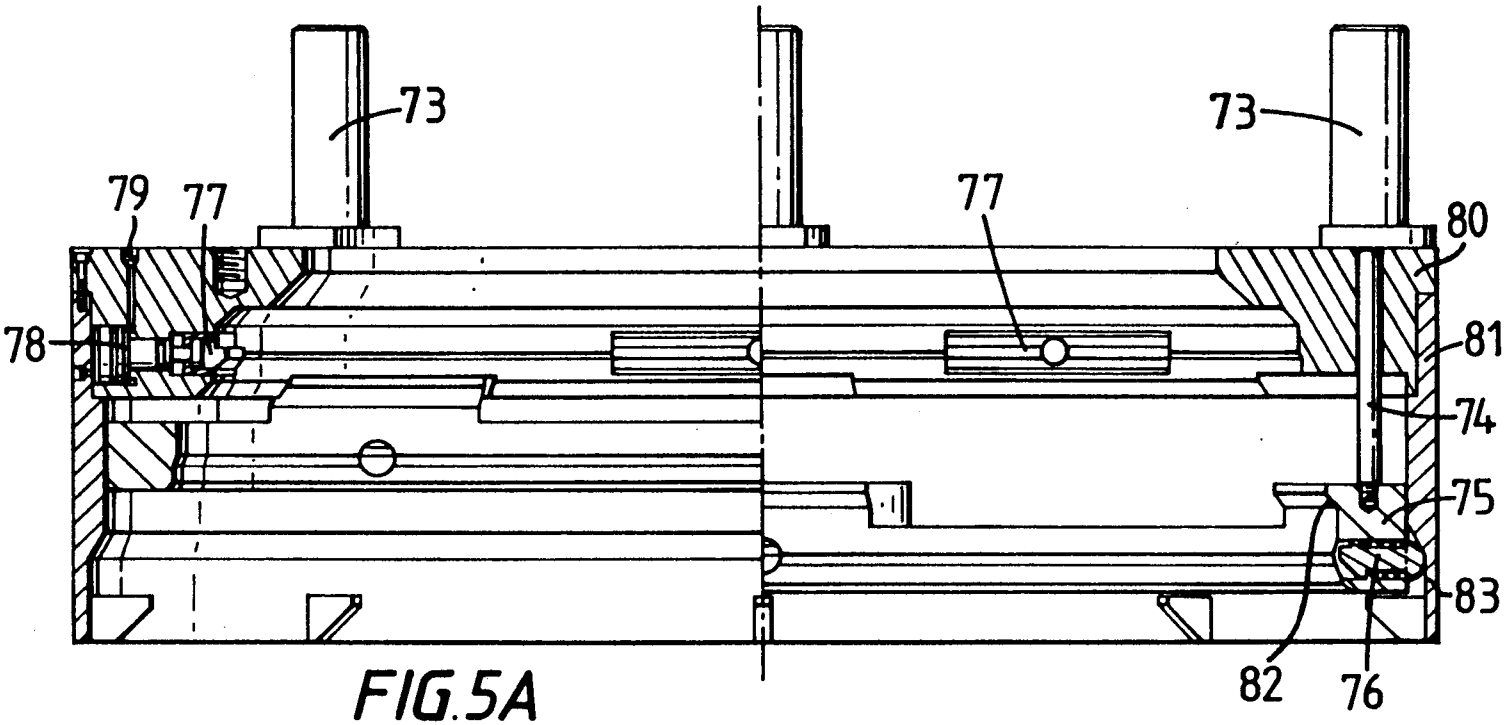
FIG. 5A is a section through part of the multi-purpose tool of FIG. 4 and FIG. 5B a detail of part of FIG. 5A.
Figure 5B:
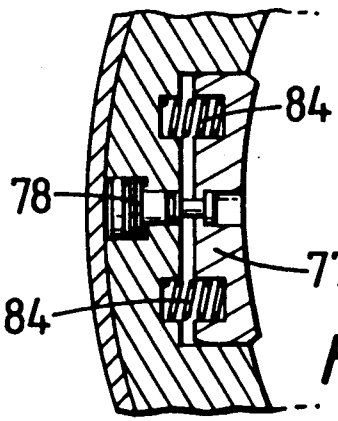

The locking and latching means of frameworks 63 and 64 are shown in more detail in FIG. 5A which is a section through framework 63 and FIG. 5B which is an enlarged section of a segment 77 in another plane. It will be appreciated that framework 64 will be the same as framework 63, except that it will be smaller in diameter.

In FIG. 5A it will be seen that framework 63 is formed of an upper body 80 and outer sleeve 81. Upper body 80 supports hydraulic cylinders 73 with their rods 74 passing through body 80 to ring 75. It will be noted that ring 75 has a chamfered shoulder 82 corresponding to the chamfered shoulders of the lock/unlock ring 38 of the retrievable guide base portion. In FIG. 5A ring 75 is shown, for purposes of illustration only, in its up position on the left hand side of the drawing and in its down position on the right hand side of the drawing. In the down position spring loaded pins 76 are in line with a recess 83 in the skirt of outer sleeve 81.

Segments 77 (FIG. 5B) are spring loaded by springs 84, the springs tending to move the segments out from body 80. FIGS. 5A and B also show hydraulic pistons 78 attached to the segments and ports 79 leading to the inside of pistons 78.

The operation of the tool will be described taking FIGS. 4, 5A and 5B together. If the operation required is to land an item, e.g. a protective cap, retrievable guide base portion, or trawler board deflector, the item is placed in the relevant framework of the tool in the moon pool of a surface vessel. Springs 84 of segments will automatically ensure that the segments will bear against the lifting shoulder of the item. The locking pins of the item must be in their unlocked positions so the lock/unlock ring of the item will be in its upper position, and to this end, ring 75 of the tool must also be in its upper position, i.e. pressure must be applied to the underside of the piston of hydraulic cylinders 73. This is the position shown at the left hand side of FIG. 4. It will be seen that while chamfer 82 of ring 75 is bearing on the chamfer of the shoulder of the lock/unlock ring of the item, spring loaded pins 76 are underneath the shoulder.

The tool carrying the item is then run and landed onto the appropriate well head or conductor housing. It may be guided by guide lines fixed to a mud mat or guide base and passing up through guide tubes 72 of the tool. Once landed, the pressure in cylinders 73 is reversed and pressure applied to the tops of the piston forcing down ring 75 and hence the lock/unlock ring it is bearing against. This locks the item onto the housing. Pins 76 are free to move into recess 83 of outer sleeve 81 (see right hand side of FIG. 4 and FIG. 5A). Segments 77 are now unlocked by applying hydraulic pressure to the inside of pistons 78 through port 79 moving the segments out of engagement with the item. The tool can now be drawn up leaving the item behind. Since pins 76 are partly in recess 83 they do not impede the removal.

For a reverse operation, viz the retrieval of an item, the tool is run and landed with an empty framework and with ring 75 in its up position. In this position ring 75 does not impede the passage of the framework over the item during landing. Segments 77, being spring loaded, will be forced back and then spring under the relevant shoulder. Hydraulic pressure is now applied to the tops of the pistons of cylinders 73 so that ring 75 moves to its down position with pins 76 in recess 83.

Reversal of pressure in cylinders 73, i.e. application of pressure to the underside of the pistons will draw ring 75 upwards. Pins 76 will come out of recess 83 and hence will bear against the underside of the shoulder of the lock/unlock ring, drawing up that ring and unlocking the item from its housing. Hydraulic pressure is maintained so that the tool carrying the item can be drawn up and the item retrieved.

As previously explained one or both frameworks may be used on the tool and, if required, one framework can effect a placement operation while the other effects a retrieval operation.

Landing and retrieval operations using the tool are assisted by guidelines if possible and the precise placement may be assisted by a ROV if required. However guidline-less operation is possible with ROV assistance, since rings are used for locking and unlocking and no orientation is required.

It should also be noted that all lock and unlock forces have local reaction forces to act against and that, if a tool is used, none of the tool functions is dependent on the weight of the tool itself.

Figure 6:
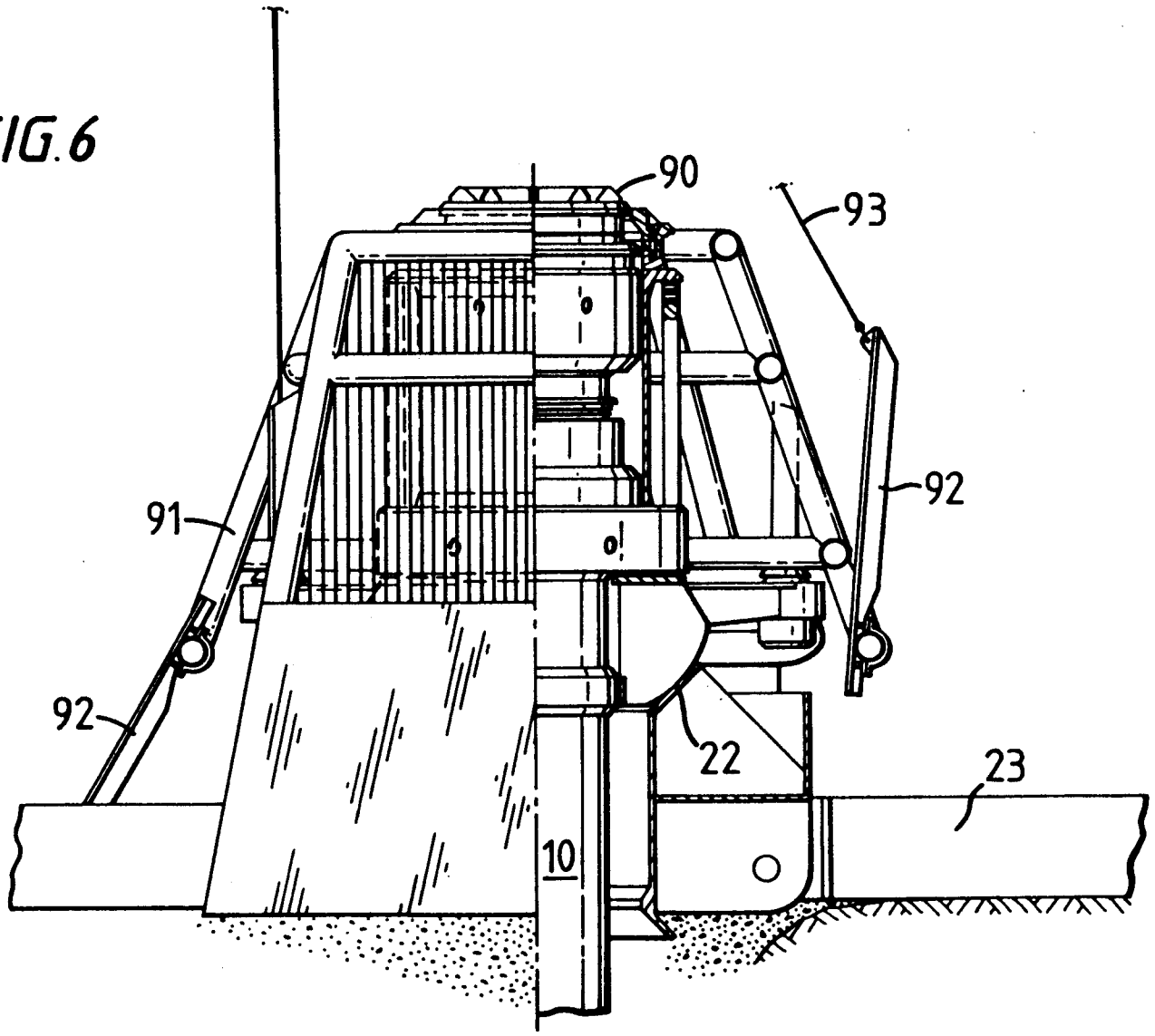
FIG. 6 is a view of a trawler board deflector, which can be deployed using the tool of FIG. 4.

A suspended well, in addition to having a protective cap, could also be protected by a trawler board deflector positioned on and locked to the center portion in place of a guide base. FIG. 6 is a view of such a suspended well with both a protective cap 90 and a conical trawler board deflector 91 in place. Deflector 91 may have hinged flaps 92 around its base. Flaps 92 may be hinged onto the deflector 91. The flaps may be held up (see right hand side of FIG. 6) by strops 93 attached to a running tool to reduce the overall diameter of the trawler board deflector during running and landing. When the tool is recovered after landing, strops 93 will be sheared allowing the flaps to fall and land on the sea bed. FIG. 6 shows how a suspended well can be totally protected against ingress of sediments and against accidental damage by physical contact. Trawler board deflector 91 can be deployed and retrieved using the multi-purpose tool of FIGS. 4 and 5A in just the same way as a guide base.

Figure 7:
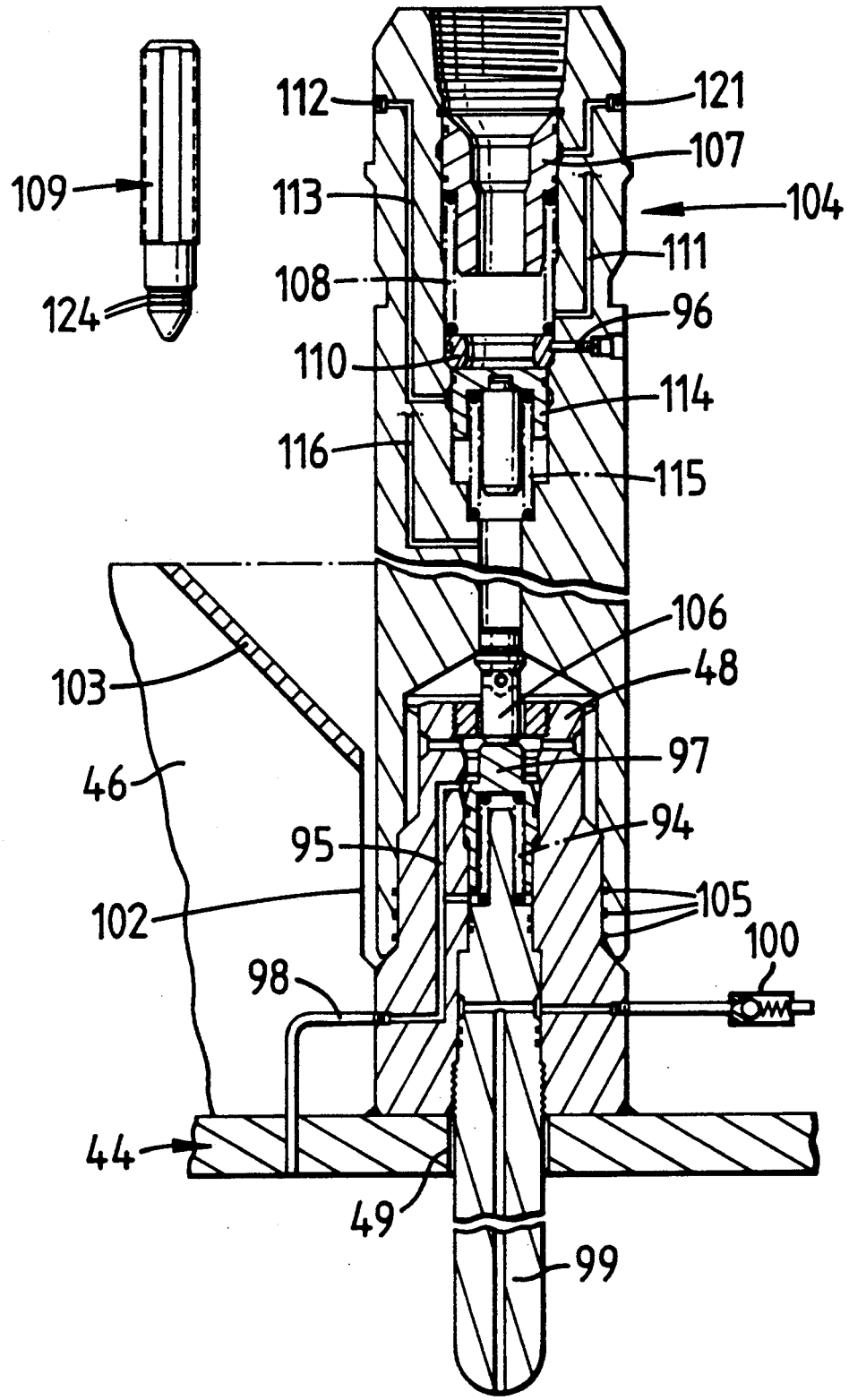
FIG. 7 is a section through a stab hydraulic controller for the multi-purpose tool of FIG. 4, the controller being in place on a protective cap.

The hydraulic fluid required to operate the multi-purpose tool of FIG. 4 may be supplied from the surface by suitable lines and may be controlled and fed to the required points of the tool in the right sequence from the surface if required. However, the tool may have its own controller to feed hydraulic fluid to the relevant parts of the tool in the right sequence. This controller may also have a provision for flushing the well head with corrosion inhibited fluid. FIG. 7 shows such a controller.

In FIG. 7, starting from the bottom, part of cup 44 of a protective cap is shown with central hole 49 and web plates 46. The protective cap has a system which allows the housing to be flushed with a corrosion inhibited fluid. This system is formed of a ported profiled pin 48 projecting above the cap frame 44, with a spring loaded isolation sleeve 97 inside it. Pipe 98 runs from pin 48 through the cap and hence into the interior of the well head housing. Spring 94 of sleeve 97 holds the sleeve up, closing passage 95 leading to pipe 98 unless the sleeve is forced down. Pipe 98 forms the inlet for flushing fluid into the well head housing. The flushing fluid outlet from the housing is up a hollow stinger 99 extending down through hole 49, and out into the hydrasphere though a check valve 100.

Pin 48 extends up within an alignment space 102 formed by web plates 46 which are chamfered to form a funnel 103 designed to receive and locate a fluid controller indicated generally at 104. This controller forms part of the multi-purpose tool of FIG. 4. The tool may be run on drill pipe and the controller may conveniently be formed of a length of 6⅝ inch diameter drill collar stock with a nose designed to fit within space 102 and around pin 48. The controller 104 supplies the flushing liquid and seals 105 are provided to seal the controller around pin 48. At the bottom end of the controller is a depression pin 106. When the controller is landed on pin 48, pin 106 contacts isolation sleeve 97 of pin 48 and forces it down against the force of spring 94 to provide a fluid path.

Controller 104 has four side ports through which fluid can be fed to other parts of the tool. The first port 121 is the tool release port and leads to inlet 79 for pistons 78 of segments 77 (see FIG. 5A). When the connector is not in use and in certain operations, port 121 is covered by dart sleeve 107 which is held by spring 108. Sleeve 107 is hollow so fluid can flow through it unless the sleeve is closed by a dart 109. There is a stop plate 110 for sleeve 107 which holds spring 108. Stop plate 110 is held in place by self-sealing screws 96. The operation of this dart sleeve and dart will be described hereafter. Dart 109 is shown for purely diagramatic purposes to the side of controller 104 but it is designed to be dropped down the drill pipe holding the tool into dart sleeve 107 when required.

The second port of controller 104 is at the same level as port 121, but being spaced around the periphery of controller is not shown in FIG. 7 but is indicated at 128 in subsequent FIGS. It can be fed with hydraulic fluid, however, by passage 111 in controller 104 which starts at a point just above stop plate 110. Port 128 of controller 104 leads to lock-unlock cylinder 73 of the tool with suitable pipe work so that fluid can be fed either to the tops of the cylinders 73 or to their bottoms. Passage 111 is not protected by any sleeve, but will be isolated from fluid if dart 109 is in sleeve 107.

A third port 112 of controller 104 is used for flushing of the well head housing. From port 112 is a passage 113 leading to check sleeve 114 held up by a spring 115, which allows sleeve 114 to act as a regulator. There is a further passage 116 which forms part of the flushing system. This has its own port, the fourth port, (not shown in FIG. 7 but indicated as 129 in subsequent FIGS.) at the same level as the other ports and there is a fluid connection between port 112 and the other port 129 through a flow reducing valve shown at 123 in subsequent figures. Passage 116 leads to the central passage of controller 104 below check sleeve 114. The flow of flushing fluid is thus through passage 113 to port 112, then through flow reducer 123, to port 129 and passegs 116 and so into the central passage of the controller and down through pin 48 into the wall.

All ports are at the same level near the top of controller 104 so that they are easily accessible. Subsequent diagrammatic figures may show them at different levels but this is purely to simplify the subsequent figures.

The operation of the controller can be explained with reference to FIG. 7, to FIGS. 8A, 8B and 8C which show the sequence of operations in a running and landing sequence and to FIGS. 9A, 9B and 9C which show a reverse operation from FIGS. 8A, 8B, and 8C.

Figure 8A:
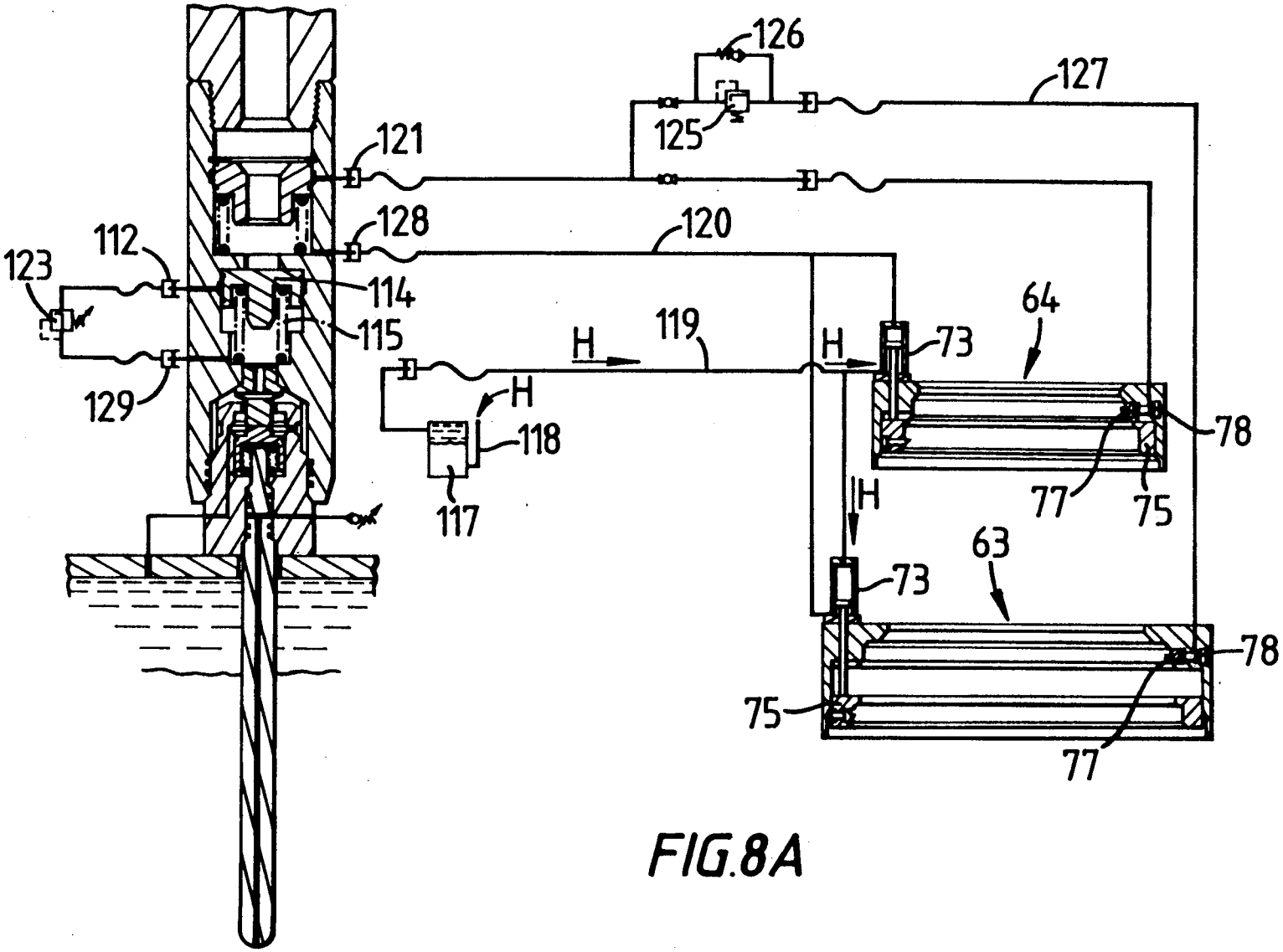
FIGS. 8A, 8B and 8C are diagrams showing one sequence of operations possible when using the multi-purpose tool of FIG. 4 and controller of FIG. 7, and FIGS. 9A, 9B and 9C are diagrams showing another sequence of operations possible when using the multi-purpose tool of FIG. 4 and controller of FIG. 7.
Figure 8B:
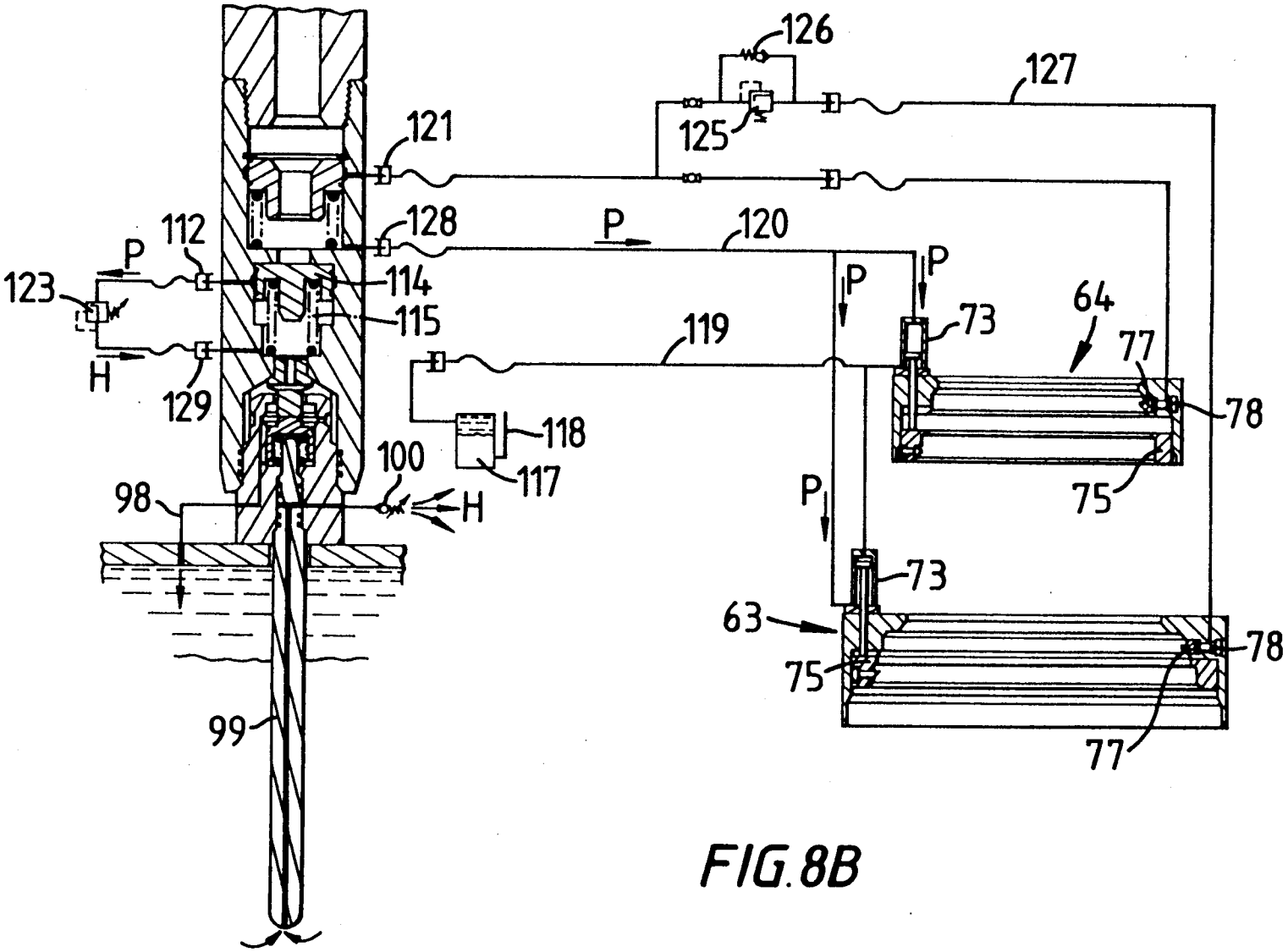
Figure 8C:
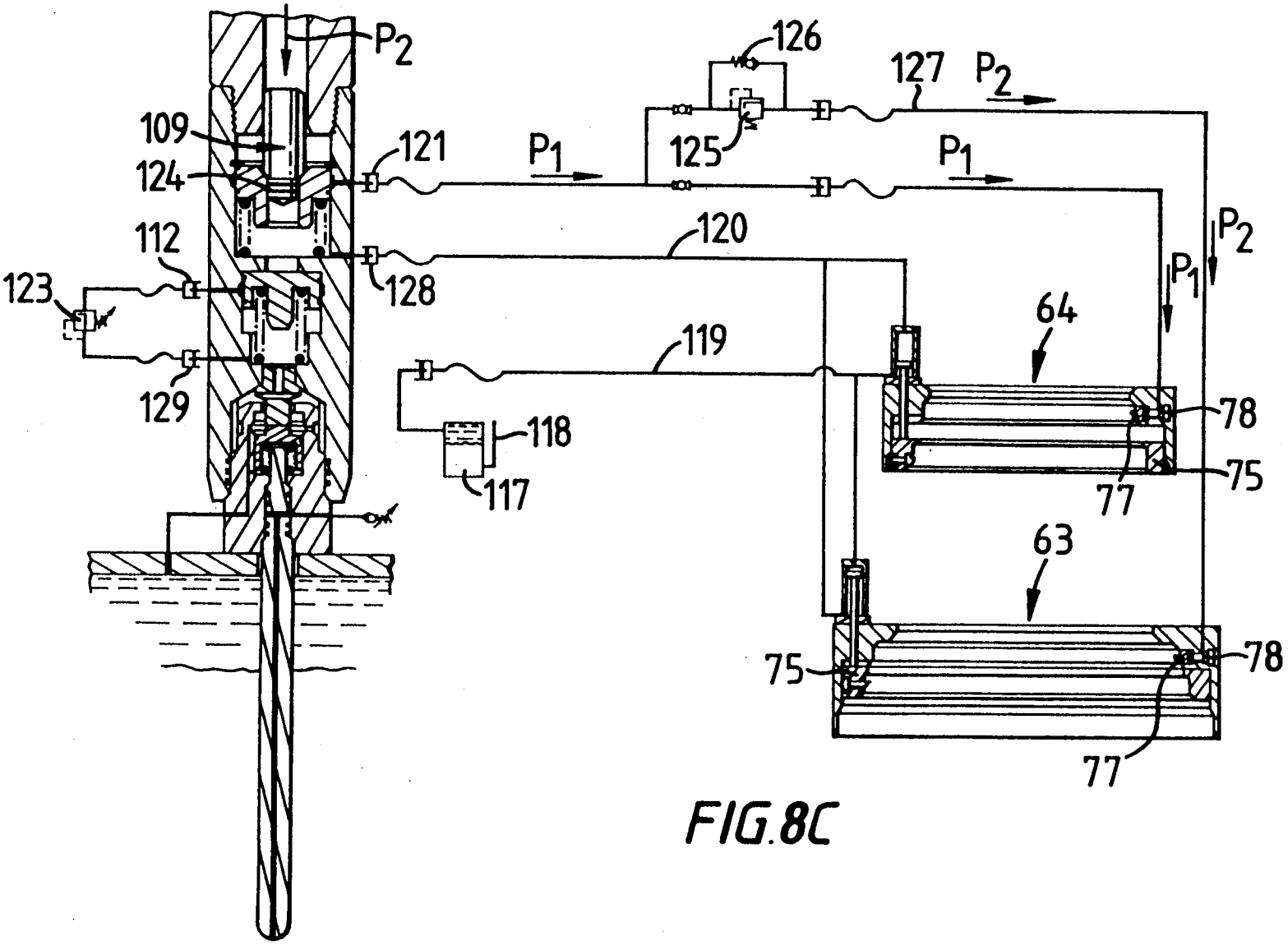

FIGS. 8A, 8B and 8C illustrate the situation where a retrievable guide base portion is on a sea bed installation. The well is to be suspended so the protective cap is placed over the well head housing and the retrievable guide base is retrieved.

The tool and controller are run on drill pipe, assisted by guide wires, as required. The running position of the various sleeves are as shown in FIGS. 7 and 8A, and the drill pipe and controller are empty of any fluid. FIG. 8A shows that the pipework connecting lock-unlock port 128 of the controller to the respective ports on cylinders 73 of framework 63 the tool has a cylinder 117 which is open to the hydrasphere through line 118. Cylinder 117 can provide an interface between sea water and the control fluid but the effect of having drill pips and controller 104 empty of fluid and the lock-unlock pipework for framework 63 open to the hydrasphere in the way shown means that cylinder 117 is pressured up by the sea water pressure so that the pistons of cylinder 73 are held in their surface set position by the hydrasphere water pressure, this in turn keeping ring 75 of framework 63 in the positively required position.

For running the protective cap, the tool has to be locked to the cap in a position to latch onto the retrievable guide base. Ring 75 of framework 63 is kept down because line 119 from interface cylinder 117 feeds to the top of cylinders 73 of framework 63. Line 119 also feeds to the bottom of cylinders 73 of framework 64 so that, in this framework, ring 75 is held in its top position, allowing a protective cap (not shown) to be placed in it in the unlocked mode. Spring loaded segments 77 automatically latch onto the cap and hold it.

The tool with a protective cap in framework 64 is run and landed as shown in FIG. 8A. When landed framework 63 will be over the locked retrieval guide base portion and framework 64 will have placed the unlocked protective cap over the wellhead housing.

When the tool has landed as shown in FIG. 8A the drill pipe is filled with a suitable corrosion inhibited hydraulic fluid, which equalises the pressures in cylinders 73. Pressure applied to the full drill pipe will overcome the hydrasphere pressure. This fluid is free to flow through passage 111 of the controller (FIG. 7) to port 128 and so into the lock-unlock system pipework along line 120, which leads to the bottom of cylinders 73 of framework 63 and to the top of the cylinders of framework 64. Ring 75 of framework 63 is forced up and ring 75 of framework 64 pushed down. The retrievable guide base portion is thus unlocked and the protective cap locked, with the desired control fluid in the open port of cylinders 73 venting into the storage container made up of the interface cylinder 117. Line 118 will ensure that there is a balancing interface between hydraulic fluid and sea water in cylinder 117. If flushing of the well head housing is required, a fluid pressure sufficient to overcome regulator spring 115 will force check sleeve 114 down and so allow fluid to pass through the flushing system.

With check sleeve 114 down fluid pumped down the drill pipe can flow along passage 113 to port 112 then through flow reducer 123 to port 129 and passage 116 and so into the central passage of the controller. When the tool is landed on pin 48, the depression pin 106 of the controller will have depressed isolation sleeve 97 against the force of spring 94. Flushing fluid will flow through passage 95 to pipe 98 and hence into the well head. As previously stated, the flushing fluid outlet is up stinger 99 and out into the hydrasphere through check valve 100.

Since the protective cap has been locked onto the well head housing the flushing can take place without any risk of the cap lifting or leaking.

Figure 9A:
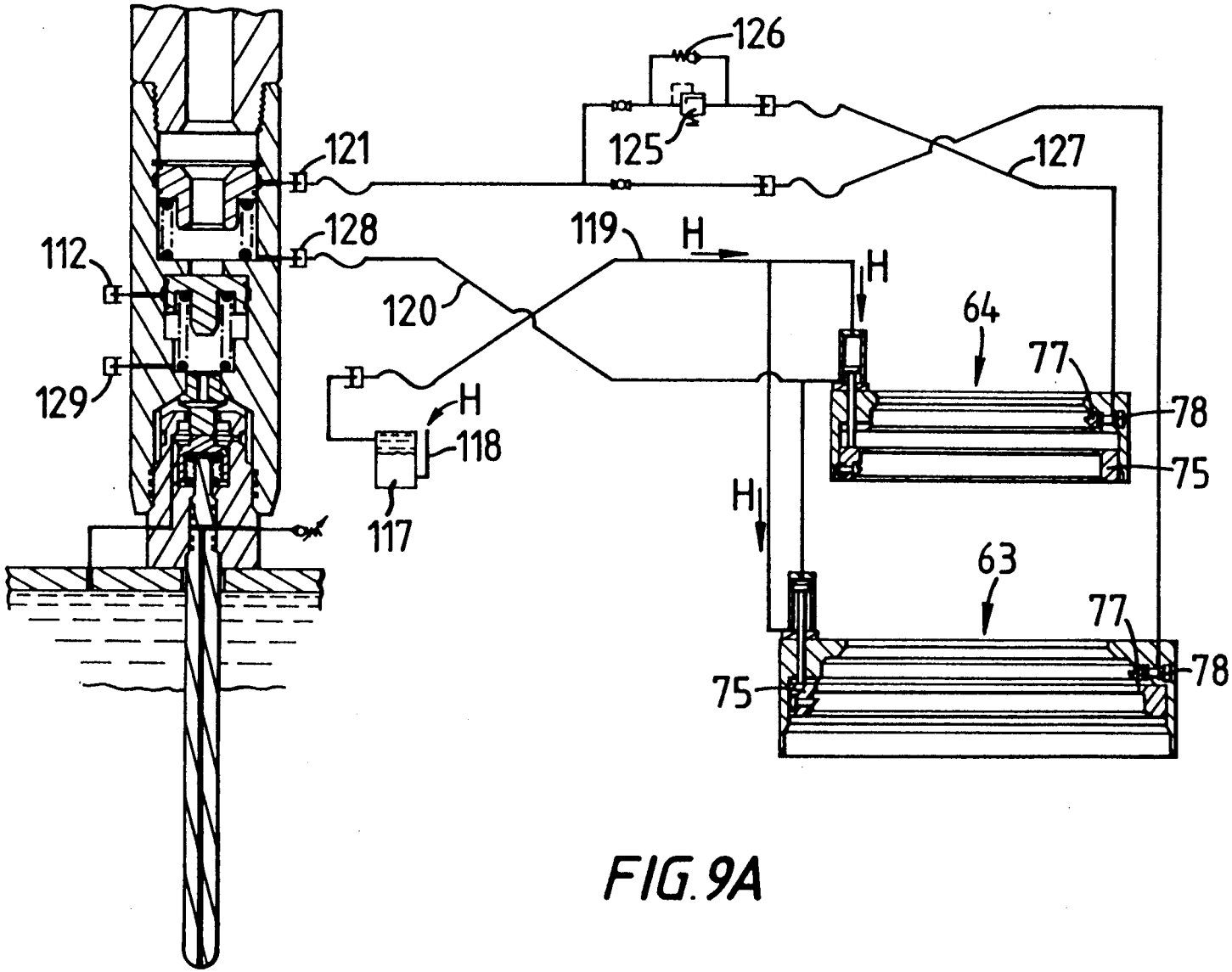
Figure 9B:
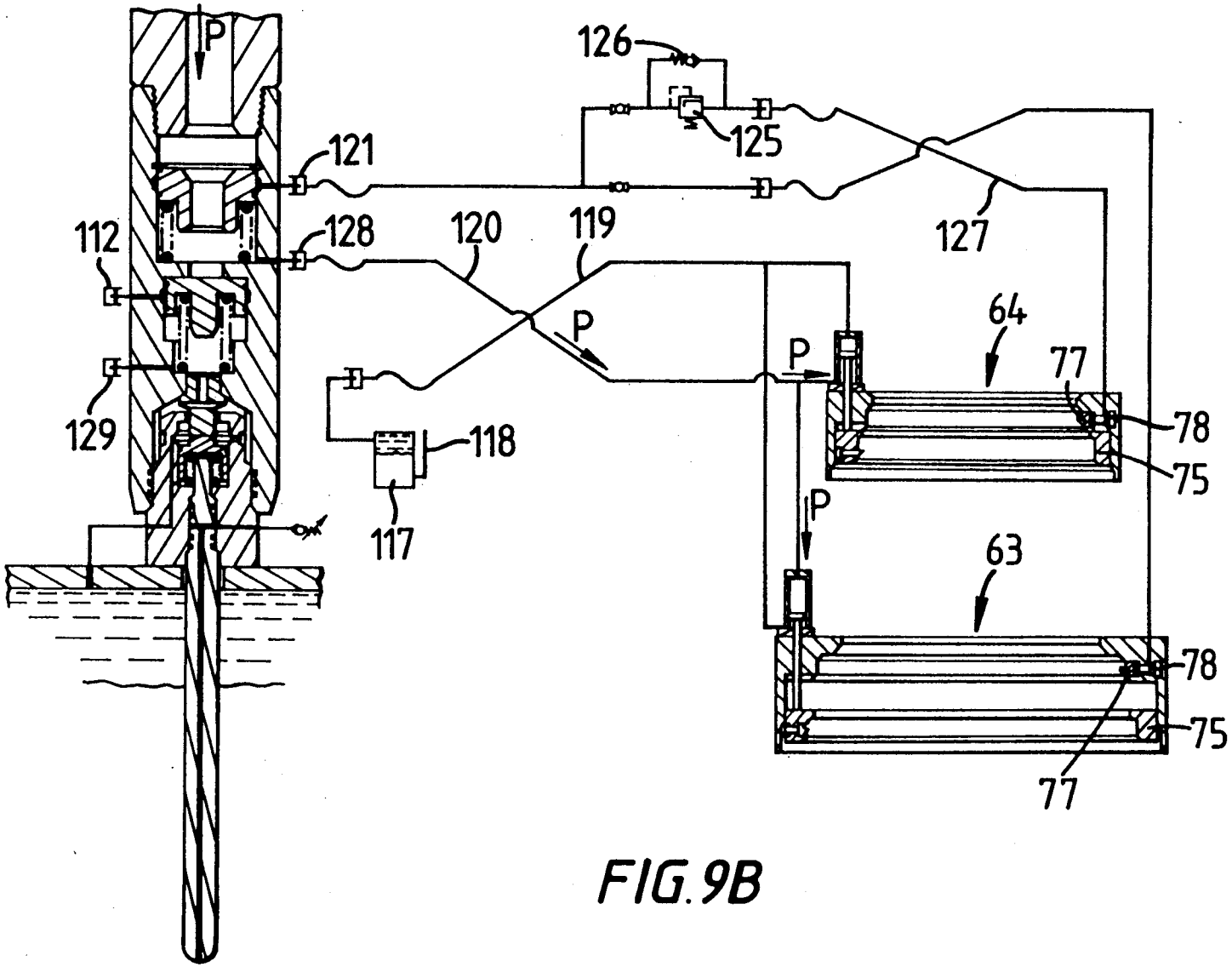
Figure 9C:
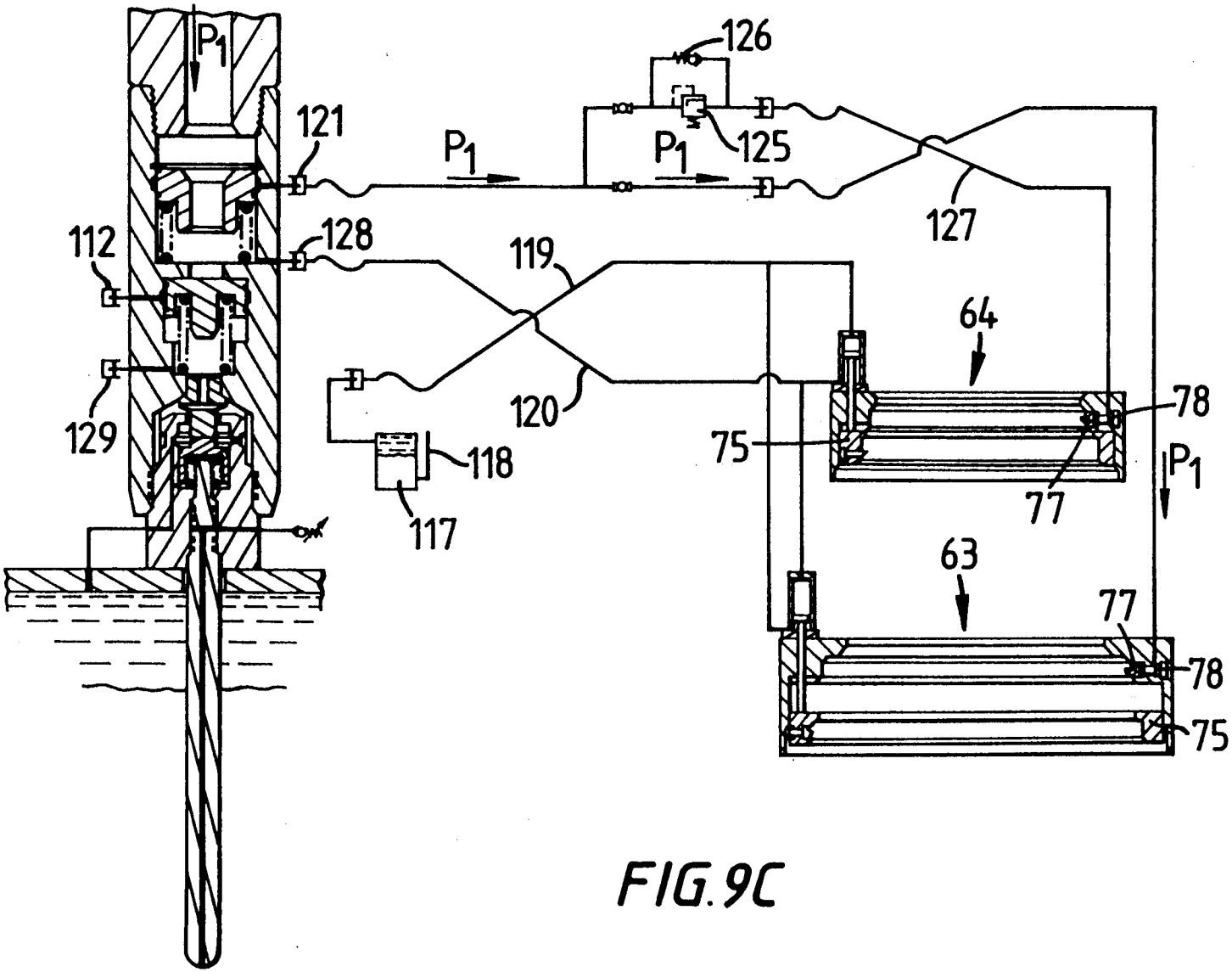

The flushing fluid system is a dual port system not only to allow the fluid to flow through flow reducer 123 but also because it allows the system to be easily blanked off if required (see FIGS. 9A, 9B and 9C).

FIG. 8B shows the position of the parts of controller 104 after the tool has been landed, the protective cap locked, the retrievable guide base portion unlocked, and the well flushed. Arrows indicate the path of the flushing fluid along pipe 98 into the well and out up the stinger.

To release the tool from the protective cap of the sub-sea assembly, the operation is as shown in FIG. 8C. Dart 109 is dropped down the drill pipe to land in dart sleeve 107 thereby blocking off fluid access to all passages and ports below sleeve 107. It will be seen that the dart has suitable seals 124 to prevent fluid getting below the sleeve. Although dart 109 is shown in FIG. 7 at the side of controller 104, this is for purposes of illustration only. The dart is not in the drill pipe for the running and landing sequence. It is only deployed for a tool release operation. The drill pipe is unscrewed on the surface vessel, the dart inserted, and the pipe screwed up again. Alternatively, the dart could be launched from a dart launching head on the drill pipe. When the dart has dropped down the pipe into the dart sleeve, further fluid is pumped into the pipe and the fluid pressure is increased until it overcomes the force of the dart sleeve spring 108 and forces the dart 109 and dart sleeve 107 down onto the stop plate 110. This uncovers release port 121. There is no hydraulic lock below dart sleeve 107 because any fluid can escape through the flushing system.

Fluid pressure in the release system moves release pistons 78 in framework 64 thereby freeing latch segments 77 in that framework. FIGS. 8A, 8B and 8C show that the pipework for the release has a regulator 125 and check valve 126 in it. Such a regulator and valve are required if, as in FIGS. 8A, 8B and 8C, the tool is operating both frameworks 63 and 64. The protective cap in framework 64 has to be left in place so latch segments 77 of this framework have to be released. However, the retrievable guide base portion in framework 63 has to be retrieved so the locked latch segments 77 of framework 63 must not be freed. Regulator 125 and check valve 126 are in line 127 leading to framework 63 and ensure that the latch segments 77 of this framework are not released at the normal release pressure. If for safety reasons, it becomes necessary to retrieve the tool from both frameworks 63 and 64, regulator 125 can be overriden by increasing the pressure thereby freeing segments 77 of both frameworks 63 and 64 and allowing the tool to be drawn up on its own. For normal operation, however, the freeing of latch segments 77 of framework 64 only means that, as the tool is pulled up to the surface on the drill pipe, it carries the retrievable guide base portion with it within framework 63, but leaves the protective cap of framework 64 in place.

FIG. 8C shows dart 109 in dart sleeve 107 to block off fluid access to port 128 but shows sleeve 107 still blocking port 121. As previously explained, sleeve 107 can be moved down against the force of spring 108 by increasing the fluid pressure thereby uncovering port 121 and effecting the latching and unlatching sequence.

If the tool is required for the reverse operation the tool is used as in FIGS. 9A, 9B and 9C.

In the operation of FIGS. 9A, 9B and 9C the operation required is to place a retrievable guide base portion using framework 63 and recover a protective cap using framework 64.

It will be seen by comparing FIGS. 9A, 9B and 9C with FIGS. 8A, 8B and 8C that all that is required is to reverse the lock/unlock lines from port 128 and the latch segment release lines from port 121. Quick release couplings can be used on the ports and lines so that this changeover can be effected simply and easily on a surface vessel.

With the line reversed, all the operations previously described as happening in framework 63 now happen in framework 64, and vice versa, and the operation need not be described in detail. In an operation to recover a protective cap, no well flushing operation will be necessary or appropriate, however, so, in FIGS. 9A, 9B and 9C no connection to flushing fluid ports 112 and 129 are shown.

The operations of FIGS. 8A, 8B and 8C may be used, for example, when a well is to be suspended for s period, and the operations of FIGS. 9A,9B and 9C, when the suspended well is to be completed.

FIGS. 8A, 8B and 8C and FIGS. 9A, 9B and 9C describe the most complex operation when both frameworks 63 and 64 are used to effect both a placement and a retrieval operation. The tool can, as previously explained, be used for a single placement or retrieval operation using only one framework. The sequence of operations will follow the same pattern as previously described but will be correspondingly simpler, with, in some operations, the well flushing lines or the latch segment release lines not being required.

The combination of retrievable parts around a well head and the use of a multi-purpose tool for landing or retrieving all the parts provides an extremely flexible and economic system not only for drilling a well, but for protecting it, if suspended, and for its subsequent completion. The retrievable parts, when they have served their purpose on any given well can be used on other wells. All the lock-unlock mechanisms require only vertical action for locking and unlocking with no torque action. Also, all running, landing and retrieving operations of the tool require no orientation of the tool itself. Finally, all the mechanisms are designed to prevent malfunction by the ingress of sediment.

I claim:

1. A guide base assembly for a sub sea well comprising:

an annular portion adapted to fit around a conductor housing and be fixed to said conductor housing and having curved plates for sealing said annular portion on a sea-bed base selected from a temporary guide base and mud mat, a retrievable guide base portion having a central annulus adapted to fit around and be releasably locked to the annular portion, releasable locking means for said releasable locking of the guide base portion to the annular portion comprising:

horizontally moveable locking pins in the guide base portion co-operating with a horizontal groove in the annular portion, a lock/unlock ring capable of vertical movement having dependent keys to connect the vertical movement of the ring to the horizontal movement of the locking pins, and a fixed shear pin to hold the lock/unlock ring in a position in which the locking pins are in their unlocked position and a spring loaded shear pin to hold the lock/unlock ring in a position in which the locking pins are in their locked position.

2. A guide base assembly as claimed in claim 1 wherein the dependent keys of the lock/unlock ring are angled and pass through holes in the horizontally movable locking pins.

3. A guide base assembly as claimed in claim 1 wherein the lock/unlock ring moves down to lock the locking pin.

4. A tool suitable for placing and recovering a guide base of a sub-sea installation comprising:

a framework adapted to be attached to means for lowering the tool to the sea bed from a surface vessel, a further framework attached to the first framework having releasable locking means for locking onto a guide base, said releasable locking means comprising:

releasable spring loaded latches for latching onto the guide base, and a ring capable of vertical movement within the second framework having spring loaded locking pins, means for moving the spring loaded latches out of engagement with the guide base, and means for moving the ring vertically, said two means being capable of independent operation.

5. A tool as claimed in claim 4 wherein the means for moving the spring loaded latches and the ring are hydraulic pistons and cylinders.

6. A tool as claimed in claim 4 having a third framework attached to the first two frameworks, said third framework also having releasable locking means identical in operation with those of the second framework and adapted to lock onto a portion of the subsea installation other than the guide base.

7. A tool as claimed in claim 4 having a controller to operate in sequence the means for moving the spring loaded latches and the ring of the second framework.

8. A tool as claimed in claim 6 having a controller to operate in sequence the means for moving the spring loaded latches and the rings of the second and third frameworks.

* * * * *